US005857943A

United States Patent [19]

Murray

[11] Patent Number: 5,857,943

[45] Date of Patent: Jan. 12, 1999

[54] ERGODYNAMICALLY DESIGNED EXERCISE DEVICE

[75] Inventor: Robin E. Murray, Daphne, Ala.

[73] Assignee: Physicians' Preference, Inc., Mobile, Ala.

[21] Appl. No.: 963,975

[22] Filed: Nov. 4, 1997

Related U.S. Application Data

[63] Continuation of Ser. No. 671,314, May 29, 1996, abandoned.

[51] Int. Cl.[6] ..... A63B 22/12; A63B 22/04

[52] U.S. Cl. ..... 482/57; 482/62

[58] Field of Search ..... 482/57, 62, 61, 482/51–53, 148, 142

[56] References Cited

U.S. PATENT DOCUMENTS

| | | | |
|---|---|---|---|
| 326,247 | 9/1885 | Root . | |
| 3,057,201 | 10/1962 | Jaeger | 482/57 |
| 3,213,852 | 10/1965 | Zent | 128/25 |
| 3,572,699 | 3/1971 | Nies | 272/73 |
| 4,071,235 | 1/1978 | Zent | 273/73 |
| 4,222,376 | 9/1980 | Praprotnk | 128/25 |
| 4,618,141 | 10/1986 | Ashworth | 272/73 |
| 4,749,182 | 6/1988 | Duggan | 272/73 |
| 5,044,627 | 9/1991 | Huang | 482/62 |
| 5,178,593 | 1/1993 | Roberts | 482/62 |
| 5,269,736 | 12/1993 | Roberts | 482/62 |
| 5,330,402 | 7/1994 | Johnson | 482/62 |
| 5,336,147 | 8/1994 | Sweeney, III | 482/57 |
| 5,338,272 | 8/1994 | Sweeney, III | 482/57 |
| 5,342,261 | 8/1994 | Johnston | 482/57 |
| 5,342,262 | 8/1994 | Hansen | 482/62 |
| 5,378,209 | 1/1995 | Kendrew | 482/52 |
| 5,569,128 | 10/1996 | Dalebout | 482/62 |

FOREIGN PATENT DOCUMENTS

| | | | |
|---|---|---|---|
| 1248616 | 8/1986 | U.S.S.R. | 482/62 |

*Primary Examiner*—Stephen R. Crow
*Attorney, Agent, or Firm*—Lanier Ford Shaver & Payne P.C.; Frank M. Caprio; Russell L. Sandidge

[57] ABSTRACT

An exercise device comprised of two independent, adjustable crank assemblies, a horizontal base and a centrally displaced pedestal. The first crank assembly is operated by the user's legs and includes two pivotally mounted pedals integrally attached to a crank system. The second crank assembly is operated by the user's arms and includes two pivotally mounted gripping means connected to a second, independent crank system. The resistance of the first and second crank assemblies are individually adjustable, enabling the user to employ varying levels of resistance to both his arms and legs. The centrally displaced pedestal functions as a means of support for the user's torso when the device is in use. The first crank assembly is attached to a generally vertical member, which vertical member is rigidly attached to the base. The second crank assembly is attached to a generally horizontal member, which horizontal member is adjustably mounted to the pedestal. The horizontal member is adjustable to a variety positions, enabling the user to operate the device in a generally horizontal position to a generally vertical position.

13 Claims, 4 Drawing Sheets

ERGODYNAMICALLY DESIGNED EXERCISE DEVICE

CROSS REFERENCE TO RELATED APPLICATIONS

This application is a continuation, of application Ser. No. 08/671,314, filed 29 May, 1996, now abandoned.

BACKGROUND OF THE INVENTION

1. Field of the Invention

The present invention relates to an exercise device. More particularly, the present invention relates to an exercise device specifically adapted to be utilized in conjunction with the major muscle groups of the human body.

2. Description of the Prior Art

Numerous innovations for an ergodynamically designed exercise device have been provided in the prior art that are described as follows. Even though these innovations may be suitable for the specific individual purposes to which they address, they differ from the present invention as hereinafter contrasted.

In U.S. Pat. No. 326,247, dated Sep. 15, 1885, Titled Exercising Machine, invented by Root, comprises a device arranged to support the body of the person exercising in a horizontal position, leaving his arms and legs free, and in levers for the hands and feet to operate, which levers are connected to a flywheel in such a manner as to operate or be operated by the same. By working said levers singly, in pairs, or otherwise, the flywheel is put in motion, and its motion reacts upon the person using the machine, thereby causing his muscles to be exercised while he is in a comparatively passive condition.

In U.S. Pat. No. 3,213,852, dated Oct. 26, 1965, Titled, Exercising Apparatus, invented by Zent, comprises an exercising apparatus, and more particularly to an apparatus which is adapted to manipulate concurrently both the arms and legs and to cause them to move through various motions of a generally circulatory nature while varying the relative positions of the arms and legs. Because the attitudes of the arms and legs are constantly changing between constricted and stretched positions, all of the limbs are given a vigorous exercising action.

In U.S. Pat. No. 4,071,235, dated Jan. 31, 1978, Titled, Adjustable Resistance Exercising Apparatus, invented by Zent, comprises a frame having a base and two horizontally spaced substantially upright elongate poste, a first of which carries a saddle seat. Mounted for rotation on the second post is a foot pedal spindle carrying first and second sprocket wheels. Also mounted for rotation of the second post is a disc spindle carrying a disc and a sprocket wheel. Mounted for rotation near the top of the second post is a hand crank spindle carrying a sprocket wheel. A drive chain is entrained over the disc sprocket wheel and the first foot pedal sprocket wheel. A second chain is entrained over the handle bar sprocket wheel and the second foot pedal sprocket wheel, which sprocket wheels are designed to provide predetermined different angular speeds to their respective spindles. A manually operable pointer is rotatable mounted on the second post to vary the spacing between two brake pads mounted on either side of the disc to provide a variable braking force to the disc to provide a variable braking force to the disc corresponding to such spacing.

In U.S. Pat. No. 3,572,699 dated Mar. 30, 1971, Titled, Bicycle Exerciser with Interconnected Hand and Foot Pedals, invented by Nies, comprises a stationary exercise device is modified to record cyclic positional information of the hand and foot operated pedals against a variable load which load level is also recorded to indicate brain damage in terms of pedal lag for either set of pedals. The apparatus may be motor driven under a specified load for a partially or totally incapacitated person for therapy for the motor brain center. Alternatively, the apparatus may be a modified conventional bicycle with a foot pedal assembly and hand operated petal assembly carried in place of the handlebars. A drive chain couples the foot pedal assembly and hand pedal assembly through separate drive sprockets. The drive sprockets consist of a series of different diameter sprockets which are selectively shiftable into engagement with the drive chain. In U.S. Pat. No. 4,618,141 dated Oct. 21, 1986, Titled, Therapeutic Exercise Device, invented by Ashworth, Jr., comprises a therapeutic exercise device mounted on a floor base having a bicycle type seat, hand cranks and foot pedals. The foot pedals turn a lower rotatable shaft equipped with a pair of identical sprockets. Each hand crank turns a rotatably interconnected portion of a split upper shaft, each of said split shaft portions equipped with a sprocket. The sprocket on one split shaft portion is slightly larger than a lower shaft sprocket, and the sprocket on the other split shaft portion is slightly smaller than a lower shaft sprocket. A pair of drive chains interconnect the upper and lower sprockets.

In U.S. Pat. No. 4,222,376 dated Sep. 16, 1980, Titled, Exercise Machine, invented by Praprotnik, comprises an exercise machine for restoring lost movement to joints and muscles includes a base to attach a chair upon which the user is seated may be mounted, to prevent the machine from tipping, and includes a vertical standard mounting a rotatable handlebar assembly and a crank assembly. The handlebar assembly includes a sloping stem rotatable on the vertical standard and handlebars rotatable on the upper sloping end of the stem, whereby propelling the handlebars about for a circular path of the stem upper end provides a wide range of movement to the arms and upper torso. The crank assembly is made up of upper and lower bicycle type crank mechanisms, for the arms and legs, coupled by a V-belt so that strong, readily moved legs may be utilized to restore movement to arms whose range of movement is impaired, or vice versa.

In U.S. Pat. No. 4,749,182 dated Jun. 7, 1988, Titled, Variable Resistance Aerobic Exercise machine, invented by Duggan, comprises an exercise apparatus for the upper extremities and upper torso. The apparatus includes a pair of handles joined to a crank interconnected by a sprocket chain to a flywheel against which a cam actuated brake is adjustably engaged. The cam actuated brake is controlled by either foot thereby eliminating the necessity of interrupting the exercise regimen to vary exercise load. The apparatus is also adjustable to accommodate different sized users.

In U.S. Pat. No. 5,330,402, dated Jul. 19, 1994, Titled, Exercising Device, invented by Johnson, comprises an exercising device wherein a rotary crank handle mechanism is mounted on the upper end portion of a frame assembly for exercising the upper body portion of a person, and an exercising mechanism is mounted on the lower portion of the frame assembly for exercising the lower body portion of the person. The upper and lower exercising mechanisms are independently operable from each other, and the upper crank handle mechanism is provided with a plurality of adjustment features so that the mechanism can be pivoted to a desired position relative to the frame assembly and the crank arms can be oriented relative to each other to recreate the effects of swimming or rowing.

In U.S. Pat. No. 5,336,147, dated Aug. 9, 1994, Titled, Exercise Machine, invented by Sweeney, III, comprises an exercise machine with a seat and two adjustable cranking mechanisms is disclosed. The first cranking mechanism has rotatable hand grips for grasping by the user's hands while the second cranking mechanism has rotatable pedals for engagement by the user's feet. This second cranking mechanism is located at a position vertically above the location of the seat. Therefore, the exerciser may not use his or her body weight when exerting pressure on the pedals. This machine exercises virtually all of a user's muscle groups, however, the configuration of the seat vertically below the second crank mechanism results in a particularly strenuous activity for a user's hamstrings. Additionally, each cranking mechanism is selectively adjustable to a plurality of exercise positions. This makes the machine adaptable to all exercisers regardless of their size and shape and permits the user to selectively vary the exertion required during the exercise.

In U.S. Pat. No. 5,336,147, dated Aug. 16, 1994, Titled, Exercise Machine, invented by Sweeney, III, comprises an exercise machine with a seat and two adjustable cranking mechanisms is disclosed. The first cranking mechanism has rotatable hand grips for grasping by the users hands while the second cranking mechanism has rotatable pedals for engagement by the user's feet. This second cranking mechanism is located at a position vertically below the location of the seat, allowing the exerciser to use his or her body weight when pushing downwardly on the pedals. Additionally, each cranking mechanism is selectively adjustable to a plurality of exercise positions. This makes the machine adaptable to all exercisers regardless of their size and shape and permits the user to selectively vary the exertion required during the exercise. In U.S. Pat. No. 5,178,593, dated Jan. 12, 1993, Titled, Combination Stationary Recumbent Exercise Apparatus and Upper Body Exerciser, invented by Roberts, comprises an exercise apparatus that is a combination stationary recumbent cycle-type exerciser and an upper body exerciser, and a method of exercising. In the upper body exerciser mode, the operator is in a normal pushup position with the hands on the pedals of the pedal mechanism. Exercising is accomplished by hand pedaling the pedal mechanism while supporting the body weight on the feet and hands. The machine has an adjustment to help support the operator's chest with a chest pad.

In U.S. Pat. No. 5,269,736, dated Dec. 14, 1993, Titled, Combination Stationary Recumbent Exercise Apparatus and Upper Body Exerciser, invented by Roberts, comprises an exercise apparatus that is a combination stationary recumbent cycle-type exerciser and an upper body exerciser, and a method of exercising. In the upper body exerciser mode, the operator is in a normal pushup position with the hands on the pedals of the pedal mechanism. Exercising is accomplished by hand pedaling the pedal mechanism while supporting the body weight on the feet and hands. The machine has an adjustment to help support the operator's chest with a chest pad.

In U.S. Pat. No. 5,378,209, dated Jan. 3, 1995, Titled, Apparatus for Exercising Arms and Legs Vertically, invented by Kendrew, comprises an apparatus designed to exercise the arms and legs in which the user stands upright on foot levers which are supported by a downward pull or a push exerted on hand levers to which the foot levers are independently connected so that the arms and legs move in opposition to each other in substantially upward and downward directions enabling a variety of pull up, pushup, and stepping or climbing exercises to be performed without the need for either weights, friction, or damping devices, and which apparatus can be constructed simply and inexpensively using off the shelf hardware components.

In U.S. Pat. No. 5,342,262, dated Aug. 30, 1994, Titled, Vertically Disposed Exercise Machine, invented by Kendrew, comprises a vertically disposed exercise machine that is designed to accommodate a user who is in a standing position. The machine includes a lower crank set having pedals adapted to receive a user's feet. The machine has a height adjustable upper crank set that is independent from the lower crank set and includes outwardly extending handles that are designed to be grasped by the user. Each crank set is operatively connected to its own flywheel by a chain or belt. Each flywheel has its own manually adjustable resistance mechanism that allows the user to independently adjust the resistance to rotation of each crank set. When operating the machine, a suer can selectively cause the rotation of the upper and/or lower crank sets by appropriate movement of his hands and/or feet.

Numerous innovations for an ergodynamic exercise device have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to an ergodynamically designed exercise devise comprising two independent crank assemblies, a horizontal base and a centrally displaced pedestal. The first crank assembly includes two pivotally mounted pedals that are operated by the user's feet. The second crank assembly includes two pivotally mounted gripping means that are operated by the user's hands. The resistance of the first and second crank assemblies are independently adjustable to accommodate the particular demands of the individual user. The centrally displaced pedestal functions as a means of support for the user's torso. The first and second crank assemblies each have two independent cranks rotatably mounted on one distal end to a spindle. The first crank assembly is attached to a generally vertical member, which vertical member is rigidly attached to the base. The second crank assembly is attached to a generally horizontal member, which horizontal member is adjustably mounted to the pedestal. The horizontal member is adjustable to a variety positions, enabling the user to operate the device in a generally horizontal position to a generally vertical position. The user operates the device by placing his or her feet on the pedals and his or her hands on the hand grips. The user, who is facing forward, then manipulates the pedals and hand grips in a circular, clockwise manner. The difficulty experienced in rotating the pedals and hand grips corresponds to the tension level selected by the user. The intended purpose of this device is to simulate the running motion of a high speed animal such as a cheetah, leopard or similar animal. Proper use of this device requires the utilization of the major muscle groups of the human body without high impact or stress to the individual.

Accordingly, it is an object of the present invention to provide an ergodynamically designed exercise device.

More particularly, it is an object of the present invention to provide an ergodynamically designed exercise device.

In keeping with these objects, and with others which will become apparent hereinafter, one feature of the present invention resides, briefly stated, in that the device provides a low impact aerobic workout.

When the ergodynamically designed exercise device is designed in accordance with the present invention, the user is able to simulate the running motion of a high speed animal.

In accordance with another feature of the present invention, one feature of the present invention is that the device provides an effective cardiovascular workout.

Another feature of the present invention is that the user is required to utilize his or her major muscle groups to operate the device properly.

Yet another feature of the present invention is that the device reduces the risk or injury typically associated with higher impact aerobic activities such as running, bicycling, aerobics and so forth.

Still another feature of the present invention is that the tension of the pedals and hand grips are independently adjustable, enabling the user to select from a plurality of tension levels for each component.

Yet still another feature of the present invention is that the height of the horizontal member is repositionable from a location where the user is generally horizontal to a position where the user is generally vertical.

Still yet another feature of the present invention is that the resistance encountered by the user is increased as the horizontal member is raised.

Another feature of the present invention is that device can be used as a means of exercise, rehabilitation or therapy.

Yet another feature of the present invention is that pedestal provides a means of support, by enabling the user to place his or her torso on the same.

Accordingly, it is a general object of the present invention to provide an ergodynamically designed exercise device.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10—ergodynamically designed exercise device (10)
12—base (12)
14—leg extension (14)
14A—leg extension tension knob (14A)
16—first assembly (16)
16A—first assembly crank (16A)
16B—first assembly pedal (16B)
16C—first assembly spindle (16C)
16D—first assembly cog (16D)
16E—first assembly cable (16E)
18—vertical member (18)
20—platform (20)
22—arm extension (22)
22A—arm extension pin (22A)
22B—arm extension tension knob (22B)
24—second assembly (24)
24A—second assembly crank (24A)
24B—second assembly grip (24B)
24C—second assembly spindle (24C)
24D—second assembly cog (24D)
24E—second assembly cable (24E)
26—case (26)

BRIEF DESCRIPTION OF THE PREFERRED EMBODIMENT

DETAILED DESCRIPTION OF THE PREFERRED EMBODIMENT

Figure 1:
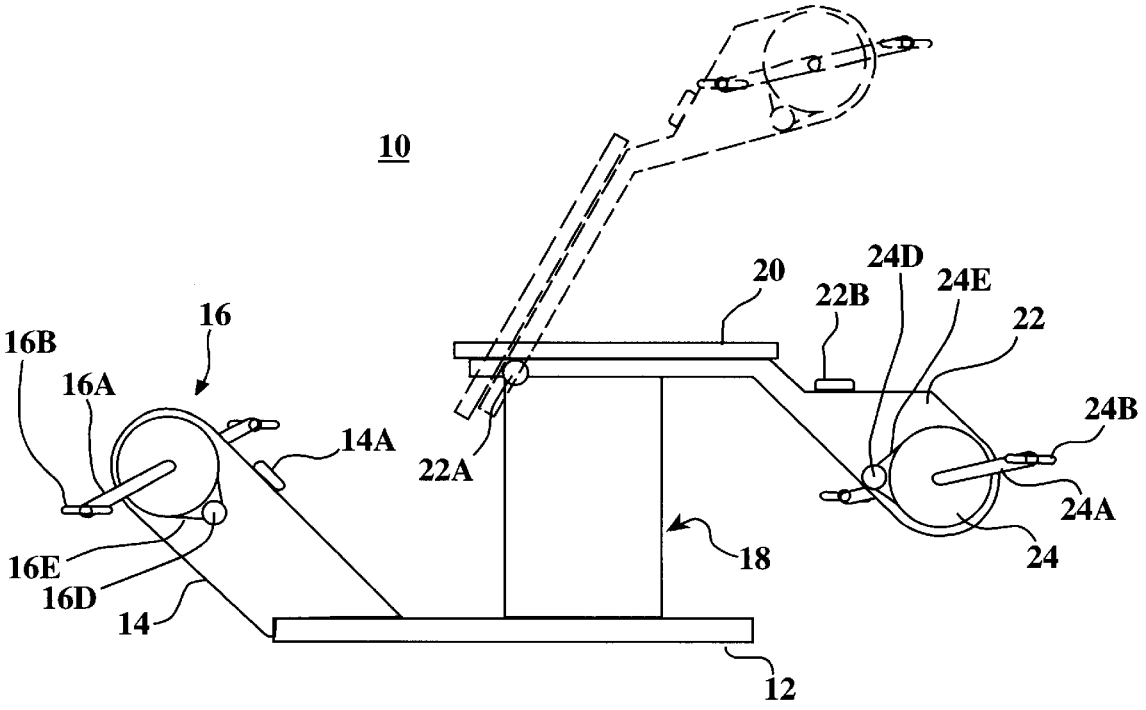
FIG. 1 is a side perspective of the ergodynamically designed exercise device.

Firstly, referring to FIG. 1 which is a side perspective of the ergodynamically designed exercise device 10 exhibiting the following features: base 12; leg extension 14; leg extension tension knob 14A; first assembly 16; first assembly crank 16A; first assembly pedal 16B; first assembly spindle 16C; first assembly cog 16D; first assembly cable 16E; vertical member 18; platform 20; arm extension 22; arm extension pin 22A; arm extension tension knob 22B; first assembly 24; first assembly crank 24A; first assembly pedal 24B; first assembly spindle 24C; first assembly cog 24D; first assembly cable 24E; case 26. The base 12, which is generally rectangular in shape, has a vertical member 18 integrally attached thereto. The vertical member 18 has a platform 20 horizontally connected thereto, the platform 18 preferably has a padded surface, and is intended to support the user's torso. The platform 20 is manufactured in such a way as to enable the user to operate the device without restricted motion. Moreover, the platform 18 does not interfere with the operation of the device should the user choose not to use the same. If the user so desires, he or she may use the platform 20 as a means of support, allowing for easier operation of the device. The platform 20 is located above the arm extension 22, said arm extension 22 protruding outwardly from the front of the device. The arm extension 22 is pivotally attached to the vertical member 18 by means of an arm extension pin 22A secured through the vertical member 18. The arm extension 22 is adjustable from a point where the user operates the device in a horizontal position, to a point where the user is in a generally vertical position. As the arm extension 22 is repositioned upwardly, an increasingly greater amount of strength is required to operate the device. A second assembly 24 is located on the opposite distal end of the arm extension 22. The second assembly 24 comprises two second assembly cranks 24A each having a second assembly grip 24B pivotally attached on one distal end. The opposite distal end of each second assembly crank 24A is rotatably mounted to either distal end of a second assembly spindle 24C. The second assembly spindle 24C is perpendicularly displaced through the arm extension 22. The second assembly cranks 24A rotate over the axis of the second assembly spindle 24C by means of the second assembly grips 24B which are operated by the user. The user grasps the second assembly grips 24B and manipulates the same in a clockwise manner. An arm extension tension knob 22A, rotatably mounted on the arm extension 22, enables the user the adjust the level of resistance by turning the same clockwise, to increase the level of resistance, or counter-clockwise, to reduce the level of resistance. A second assembly cable 24E, secured around the second assembly spindle 24C and a second assembly cog 24E, functions as a means of resistance when the second assembly 22 is in use.

The device also comprises a leg extension 14 integrally attached to the rear of the base 12. The leg extension 14 extends upwardly from the rear of the base 12 and functions as a means to exercise the user's legs. The leg extension 14 comprises a first assembly 16 having two first assembly pedals 16B each being pivotally attached to a first assembly crank 16A. The first assembly cranks 16B are rotatably mounted on opposite distal ends of a first assembly spindle 16C which is perpendicularly displaced within the first assembly 16. A leg extension tension knob 14A movably attached toward the top of the leg extension 14 enables the user to adjust the tension level of the first assembly 16 by turning the same either clockwise or counter-clockwise. A first assembly cable 16E secured around a first assembly cog 16D and the first assembly spindle 16C functions as a means of resistance when the first assembly 16 is in use. To operate the first assembly 16, the user places one foot on each first assembly pedal 16B and manipulates the same in a clockwise fashion.

Figure 2:
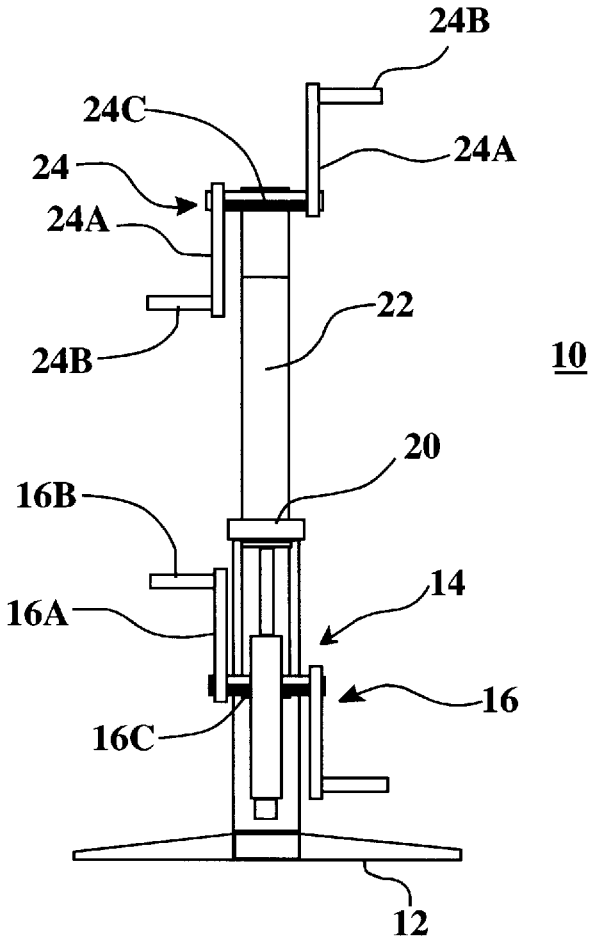
FIG. 2 is a front perspective of the ergodynamically designed exercise device.

Secondly, referring to FIG. 2 which is a front view of the ergodynamically designed exercise device 10 exhibiting the arm extension 22 in a generally vertical position. As discussed hereinbefore, the arm extension 22 is repositionally connected to the vertical member 18 enabling the user to operate the device from a generally horizontal position to a generally vertical position. As the position of the arm extension 22 is elevated to a more vertical position, the degree of difficulty encountered in the operation of the device becomes greater.

Figure 3:
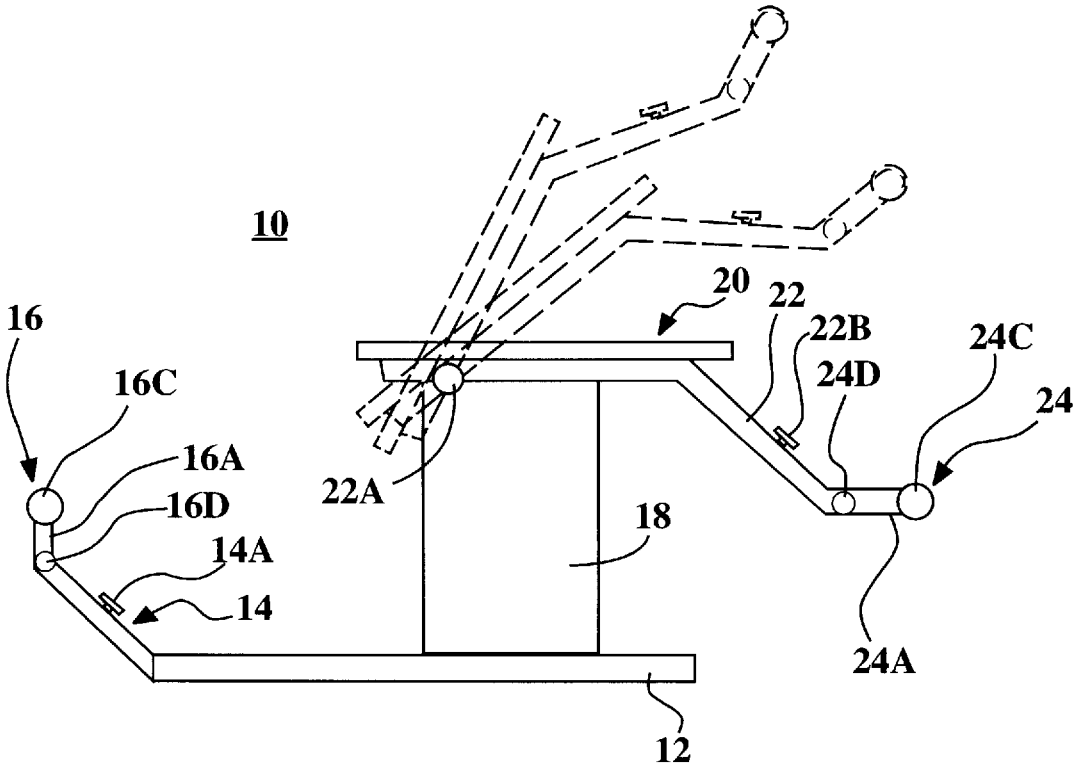
FIG. 3 is a side perspective of the ergodynamically designed exercise device.

Referring to FIG. 3 which is a side view of the ergodynamically designed exercise device 10 exhibiting the range of motion of the arm extension 22. Because the platform 20 is situated directly above the arm extension 22, the platform 20 is always in a position to provide support for the user's torso should the user so require.

Figure 4:
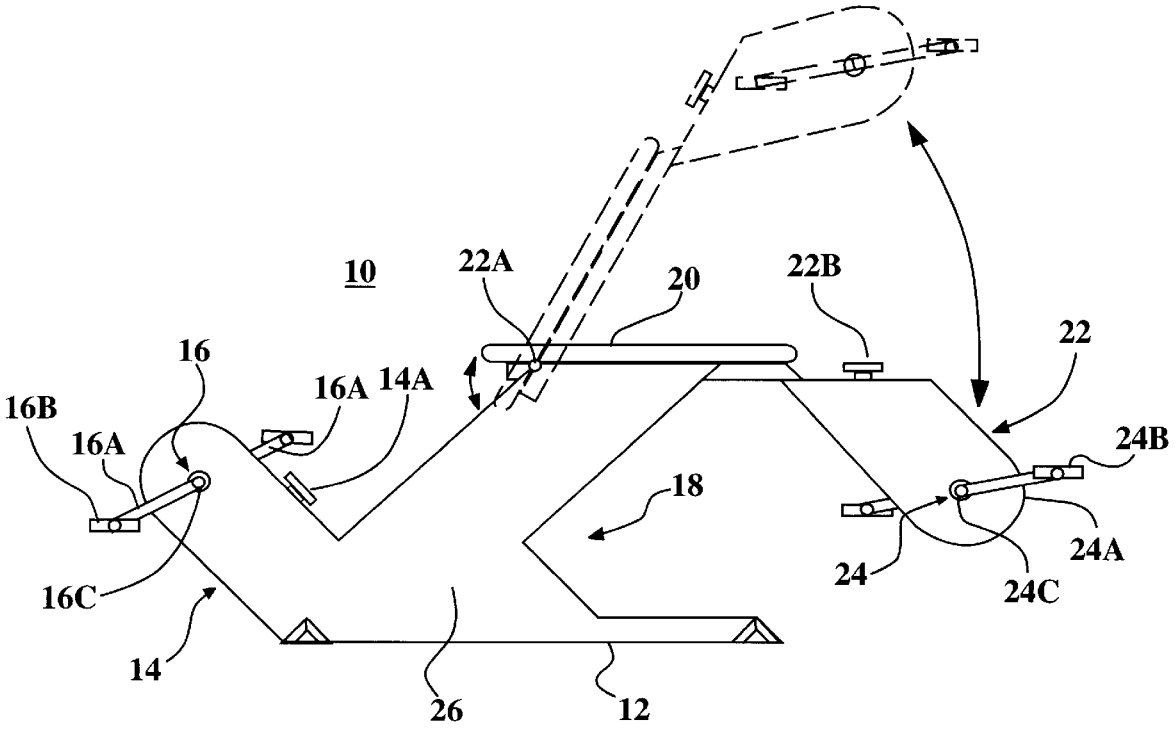
FIG. 4 is a side perspective of the ergodynamically designed exercise device enclosed by an outer case.

Referring to FIG. 4 which is a side view of the ergodynamically designed exercise device 10 enclosed within an exterior case 26. The case 26 generally covers the device, leaving only the first assembly 16, second assembly 24, leg extension tension knob 14A and arm extension tension knob 22A exposed. The case 26 is designed to cover the device without impeding the ability to use the same in its intended manner. The case 26 is preferably manufactured from plastic or plastic composite, adding very little to the overall weight of the device. The case 26 functions to increase the aesthetic appearance of the exercise device 10 and can be designed in various fashions.

It will be understood that each of the elements described above, or two or more together, may also find a useful application in other types of constructions differing from the type described above.

While the invention has been illustrated and described as embodied in an ergodynamic exercise machine, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. An ergodynamically designed exercise device comprising:

a) a horizontal base having a leg extension integrally attached at an angular projection to one distal end and a vertical member integrally attached at a generally perpendicular projection near the opposite distal end;

b) wherein the leg extension comprises a first assembly having two first assembly pedals pivotally mounted to two first assembly cranks that are rotatably connected to opposite distal ends of a first assembly spindle, the leg extension further comprises a first assembly cable secured around a leg extension tension knob and a first assembly cog; and c) wherein the vertical member comprises a pedestal having a generally horizontal top planar comprises an arm extension adjustably and pivotally engaged to said vertical member by means of an arm extension pin, the arm extension has a second assembly having two second assembly grips pivotally mounted to two second assembly cranks that are rotatably connected to opposite distal ends of a second assembly spindle, the arm extension further comprises a second assembly cable secured around an arm extension tension knob and a second assembly cog said arm extension further comprising a means for supporting a user's torso wherein the arm extension is angularly adjustable with respect to said pedestal including a horizontal position which rests upon said planar surface.

2. The ergodynamically designed exercise device as described in claim 1, wherein the arm extension is repositional from a generally horizontal placement to a generally vertical placement.

3. The ergodynamically designed exercise device as described in claim 1, wherein the leg extension tension knob and the arm extension tension knob enable the user to adjust the resistance of the first assembly and the second assembly, respectively, by turning the same clockwise to tighten the resistance and counter-clockwise to loosen the resistance.

4. The ergodynamically designed exercise device as described in claim 1, further comprising a platform joined to the vertical member, wherein said platform functions as a means of support for the user's torso.

5. The ergodynamically designed exercise device as described in claim 4, wherein the platform comprises a padded surface and interior.

6. The ergodynamically designed exercise device as described in claim 1, wherein the first and second assembly spindles, the first and second assembly cables, the vertical members, the leg extension, and the arm extension, are enclosed in an aesthetically designed case which surrounds the device.

7. The ergodynamically designed exercise device as described in claim 6, wherein the case is manufactured from plastic.

8. The device as described in claim 1 wherein a user operates said device by rotating said first assembly pedals with his or her feet, and said second assembly grips with his or her hands.

9. The device as described in claim 4 wherein a user operates said device by placing her torso on said platform and by rotating said first assembly pedals with his or her feet, and said second assembly grips with his or her hands.

10. An exercise device for exercising the legs and arms of a user, the exercise device comprising:

(a) a base;

(b) a leg extension rigidly and directly joined to said base;

(c) a first assembly crank rotatably carried by said leg extension, said first assembly crank being operable by the legs;

(d) a vertical member said vertical member comprises a pedestal having a generally horizontal top planar surface and further rigidly and directly joined to said base;

(e) an arm extension pivotally joined to said vertical member, said arm extension including an elongated platform suitable for supporting the weight of the user; and (f) a second assembly crank rotatably carried by said arm extension, said second assembly crank operable by the arms wherein the arm extension is angularly adjustable with respect to said pedestal including a horizontal position which rests upon said planar surface.

11. The exercise device of claim 10, further comprising an arm extension pin pivotally attaching said arm extension to said vertical member.

12. The exercise device of claim 11, wherein said arm extension pin is located on said vertical member toward said first assembly crank and away from said second assembly crank, so that the weight of said arm extension biases said arm extension into contact with said vertical member.

13. The exercise device of claim 10, wherein said arm extension is pivotable between a horizontal position, wherein said arm extension rests upon said vertical member, and an approximately vertical position, wherein said arm extension is pivoted away from said vertical member.

* * * * *

UNITED STATES PATENT AND TRADEMARK OFFICE

CERTIFICATE OF CORRECTION

PATENT NO : 5,857,943

DATED : January 12, 1999

INVENTOR(S) : Robin E. Murray

It is certified that error appears in the above-identified patent and that said Letters Patent is hereby corrected as shown below:

Col. 8, line 9
replace "planar comprises an"
with --planar surface and further comprises an--.

Col. 8, line 42
replace "the vertical members, "
with --and the vertical member--.

Col. 8, line 43
replace the leg extension, and the arm extension"
with -- are--.

Signed and Sealed this

Eighteenth Day of May, 1999

*Attest:*

Q. TODD DICKINSON

*Attesting Officer*

*Acting Commissioner of Patents and Trademarks*